US007206530B2

(12) United States Patent
Yang et al.

(10) Patent No.: US 7,206,530 B2
(45) Date of Patent: Apr. 17, 2007

(54) CONTROL METHOD FOR CORRECTING SENSITIVITY OF TONER DENSITY SENSOR OF IMAGE FORMING APPARATUS

(75) Inventors: Cheol-ju Yang, Suwon-si (KR); Woo-jung Shim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 241 days.

(21) Appl. No.: 10/984,827

(22) Filed: Nov. 10, 2004

(65) Prior Publication Data

US 2005/0100356 A1 May 12, 2005

(30) Foreign Application Priority Data

Nov. 11, 2003 (KR) ..... 10-2003-0079535
Nov. 17, 2003 (KR) ..... 10-2003-0080965

(51) Int. Cl.
*G03G 15/00* (2006.01)

(52) U.S. Cl. ..... 399/49

(58) Field of Classification Search ..... 399/38, 399/46, 49, 72, 74
See application file for complete search history.

(56) References Cited

U.S. PATENT DOCUMENTS 5,710,958 A * 1/1998 Raj ..... 399/49
6,792,220 B2 * 9/2004 Randall et al. ..... 399/49

FOREIGN PATENT DOCUMENTS

| | | |
|---|---|---|
| JP | 61-124973 | 6/1986 |
| JP | 07-261528 | 10/1995 |
| JP | 08-030047 | 2/1996 |
| JP | 11-167320 | 6/1999 |
| KR | 1997-0058937 | 8/1997 |
| KR | 1999-0079819 | 11/1999 |

* cited by examiner

*Primary Examiner*—Hoan Tran
(74) *Attorney, Agent, or Firm*—Roylance, Abrams, Berdo & Goodman, L.L.P.

(57) ABSTRACT

A controlling method of an image forming apparatus for finely controlling the sensitivity of a density sensor in response to various changes of a printing environment. The controlling method of the image forming apparatus uses one or more of the following methods, alone or in any combination, to control the sensitivity of a density sensor. The methods can include a sensitivity correction method for controlling an output signal of the density sensor according to amount of light irradiated to an image carrier from a light source, a sensitivity correction method for correcting a reference value according to an output signal of the density sensor, and a sensitivity correction method for changing the signal output from the density sensor using a predetermined process.

43 Claims, 8 Drawing Sheets

CONTROL METHOD FOR CORRECTING SENSITIVITY OF TONER DENSITY SENSOR OF IMAGE FORMING APPARATUS

CROSS-REFERENCE TO RELATED APPLICATIONS

This application claims the benefit under 35 U.S.C. §119 (a) of Korean Patent Application No. 2003-79535 filed in the Korean Intellectual Property Office on Nov. 11, 2003, and Korean Patent Application No. 2003-80965 filed in the Korean Intellectual Property Office on Nov. 17, 2003, the entire contents of each of which are incorporated herein by reference.

BACKGROUND OF THE INVENTION

1. Field of the Invention

The present invention relates to an image forming apparatus. More particularly, the present invention relates to a method for controlling an image forming apparatus having a density sensor for measuring developer density of an image formed on an image carrier during the driving of the image forming apparatus.

2. Description of the Related Art

An image forming apparatus is an electric device for printing images on a recording medium. Generally, a copier, a printer, a multifunctional device, and a facsimile are included in the image forming apparatus. The image forming apparatus is classified into an inkjet type image forming apparatus and an electro-photographic process image forming apparatus based on the method used for recording an image on the recording medium. The electro-photographic process image forming apparatus records an image on the recording medium by using a developing unit, and then firmly fixes the recorded image on the recording medium by pressing the recording medium with the recorded image at a high temperature.

FIG. 1 is a diagram illustrating a conventional developing unit of a laser beam printer which is capable of printing multi-color images.

Referring to FIG. 1, the conventional developing unit 10 includes an image carrier 11, an optical beam scanning means 13 for forming a latent image by irradiating an optical beam on the image carrier 11, at least one or more developer carriers 12 for applying the developer based on the latent image formed on the image carrier 11, and transferring units 16 and 17 for transferring the image formed on the image carrier 11 onto the recording medium. The image carrier 11 can be implemented as a belt type or as a roller type as shown in FIG. 1. As an example, the transferring unit 17 is provided as an intermediate transfer belt (ITB) that is used in the developing unit of the image forming apparatus having a plurality of developer carriers 12 for printing images.

The developing unit 10 needs to control the amount of developer (Toner Area Coverage, or TAC) applied for forming images on a surface of the image carrier 11 in order to manage a quality of printing. Accordingly, the developing unit 10 includes a color toner density sensor (CTD sensor) 15 for measuring developer density of the image formed on the surface of the image carrier 11.

Generally, an optical sensor is used as the CTD sensor 15. The optical sensor outputs a varied level of signals according to the amount of reflected light from the image carrier 11. The optical sensor 15 includes a light source for irradiating a predetermined amount of light to the image carrier 11, and a light receiving unit for measuring an amount of light reflected from the image carrier 11.

For accurately measuring the developer density of the image carrier 11 during the driving of the image forming apparatus, a reference value for comparing a developer density of an object image during the driving of the image forming apparatus must be accurately setup.

However, the sensitivity of a conventional CTD sensor 15 may be easily varied according to changes in the printing environment, such as by the replacement of the image carrier and the aging of the image carrier. That is, the density sensor 15 is very sensitive to the changes in the printing environment. The above problems of the conventional CTD sensor 15 may cause inaccurate references to be setup for comparisons. Accordingly, the developer density of the image may not be accurately controlled, and allow the quality of printing images to degrade. Also, the image forming apparatus may be suddenly stopped by such an error in the CTD sensor 15. For overcoming the above problems, various conventional methods have been introduced for correcting the sensitivity of the CTD sensor 15 in response to changes in the printing environment. However, none of the introduced conventional methods can fully correct the sensitivity problems of the CTD sensor 15.

Accordingly, a need exists for a system and method for accurately correcting the sensitivity of the CTD sensor 15 in response to various driving environments of the image forming apparatus.

SUMMARY OF THE INVENTION

Accordingly, the present invention has been made to solve the above and other problems. An aspect of the present invention is to provide a control method of an image forming apparatus for accurately controlling a developer density of images in various printing environments.

In accordance with an aspect of the present invention, a controlling method is provided for an image forming apparatus having a density sensor measuring a toner area coverage (TAC) applied on an image carrier. The measurement is achieved by measuring an amount of light reflected from the image carrier and outputting a measuring value based on the measured toner area coverage. The controlling method includes the steps of calculating a first measuring value corresponding to an amount of light reflected from the image carrier after a predetermined optical beam is scanned to the image carrier, then defining a second reference value by selecting one of the previously determined first reference values which is close to the first measuring value, and then calculating a second measuring value as a reference for comparison when measuring a toner area coverage of an image formed on the image carrier during the driving of the image forming apparatus. The measuring of the toner area coverage is then achieved by correcting a sensitivity of the density sensor which corrects the first measuring value based on the second reference value.

In the step for defining the second reference value, the second reference value is defined by first selecting the first reference values that are smaller than the first measuring value, and then the second reference value is defined by selecting the largest one from among the first reference values that are smaller than the first measuring value.

The step for defining the second reference value further includes the following steps (a) calculating a new first reference value by repeatedly subtracting a predetermined constant from the largest one from among the first reference values for a predetermined number of times, and (b) defining the newly calculated first reference value as the second reference value, wherein the predetermined constant is repeatedly subtracted from the largest one of the first reference values until the calculated first reference value becomes smaller than the first measuring value.

In the step (a), it is preferable to determine that the correction of the sensitivity of the density sensor has failed when the finally calculated first reference value is smaller than the first measuring value.

It is also preferable that the step for defining the second reference value further includes the steps of controlling an amount of light irradiated to the image carrier until the density sensor outputs a first measuring value closest to the second reference value, and defining the final first measuring value as the second measuring value.

It is also preferable to determine that the control of the sensitivity of the density sensor has failed when the controlled amount of light is smaller than a predetermined minimum amount of light.

It is also preferable to determine that the control of the sensitivity of the density sensor has failed when the calculated second reference value is smaller than a predetermined minimum reference value.

In accordance with another aspect of the present invention, a controlling method is provided for an image forming apparatus including a density sensor outputting a measuring value corresponding to a toner area coverage (TAC) applied on an image carrier by measuring an amount of light reflected from the image carrier. The controlling method includes the steps of calculating a first measuring value corresponding to an amount of light reflected from the image carrier after a predetermined light is irradiated to the image carrier, comparing the first measuring value with a predetermined first reference range, and then correcting an output signal of the density sensor by using a predetermined correcting process when the first measuring value is out of the first reference range, wherein the TAC of an image formed on the image carrier is measured based on results of the predetermined correcting process.

It is preferable that the step for correcting the output signal of the density sensor further includes the steps of calculating a second measuring value by correcting the first measuring value to be close to the first reference range, comparing the second measuring value and the first reference range, forming a plurality of test patterns each of which having different TAC on the image carrier, and then calculating a plurality of third measuring values for each of the test patterns.

It is also preferable to calculate a first reference data by processing the third measuring values, where the first reference data is a reference for comparison when the TAC of an image formed on the image carrier is measured during the driving of the image forming apparatus and when the second measuring value is within the first reference range.

Where the second measuring value is out of the first reference range, it is also preferable to include the steps of calculating a plurality of fourth measuring values, corresponding to the third measuring values, by correcting the third measuring values and then calculating a second reference data by processing the fourth measuring values, wherein the second reference data is a reference for comparison when the TAC of the image is measured during the driving of the image forming apparatus.

It is also preferable that the step for calculating the fourth measuring values includes the steps of calculating a measurement error which is the difference between the first reference value and the second measuring value, and then calculating the fourth measuring values by performing the correction process based on the calculated measurement error and the third measuring values.

It is also preferable that the fourth measuring value (Ldn) is calculated by using following equation (1), $$Ldn=Ln-(E\times S3n) \quad (1)$$

wherein E is the measurement error, S3n is a predetermined third reference value corresponding to an $n^{th}$ test pattern from among the test patterns, and Ln is the third measuring value calculated by measuring the $n^{th}$ test pattern.

It is also preferable that the image forming apparatus includes an image carrier identifying unit for identifying unique identification information of different image carriers, wherein the unique identification information includes information related to the first reference value, the third reference value, and the first reference range.

It is also preferable that the second reference data is defined based on the fourth reference values when the fourth reference values are included within a second predetermined reference range corresponding to each of the test patterns. The fourth measuring values are then repeatedly calculated by repeatedly performing the step for calculating the third measuring values.

It is also preferable that the step for calculating the third measuring values is repeatedly performed until the fourth reference values are included within the second reference range when the newly set fourth reference values are out of the second reference range. The process is terminated after any malfunction of the image forming apparatus is noticed, such as when the fourth reference values are out of the second reference range even after performing the step for calculating the third measuring values for a predetermined number of times.

It is also preferable that the step for calculating the second measuring value is performed when the first measuring value is out of the first reference range, and when the first reference range is out of the third reference range, wherein the first measuring value is defined as the second measuring value. The step for calculating the third measuring value and the step for calculating the fourth measuring value are orderly performed when the first measuring value is out of the first reference range and within the third reference range.

In accordance with still another aspect of the present invention, a controlling method is provided for an image forming apparatus having a density sensor measuring a toner area coverage (TAC) applied on an image carrier. The measurement is achieved by measuring an amount of light reflected from the image carrier and outputting a measuring value based on the measured toner area coverage. The controlling method includes the steps of calculating a first measuring value corresponding to an amount of light reflected from the image carrier after a predetermined optical beam is scanned to the image carrier, then defining a second reference value by selecting one of the previously determined first reference values which is close to the first measuring value, and then calculating a second measuring value as a reference for comparison when measuring a toner area coverage of an image formed on the image carrier during the driving of the image forming apparatus. The measuring of the toner area coverage is then achieved by correcting a sensitivity of the density sensor which corrects the first measuring value based on the second reference value. The method determines that the control of the sensitivity of the density sensor has failed when a predetermined condition is not satisfied. An output signal of the density sensor is corrected by a predetermined correcting process in such a failure case to correct the sensitivity of the density sensor, and the TAC of an image formed on the image carrier is then measured during the driving of the image forming apparatus based on the result of the predetermined correcting process.

It is also preferable to include the steps of applying a plurality of test patterns, each of which having different TAC, on the image carrier and then calculating a plurality of third measuring values corresponding to the TAC of the test patterns in cases where the predetermined condition is satisfied and when the second measuring value is calculated. The system further calculates a first reference data by processing the calculated third measuring values, where the first reference data is for comparison when the TAC of an image formed on the image carrier is measured during the driving of the image forming apparatus.

The output signal of the density sensor is corrected by the steps of calculating the third measuring values after forming the test patterns, correcting the third measuring values by using the predetermined correcting process, calculating fourth measuring values corresponding to each of the third measuring values, and then calculating the second reference data by processing the fourth measuring values, wherein the second reference data is a reference for comparison when the TAC of an image formed on the image carrier is measured during the driving of the image forming apparatus.

It is also preferable that the image forming apparatus includes a plurality of developing units for providing plural developer colors to the image carrier for recording color images, and that the first and the second reference data are independently defined according to each of the developers.

It is also preferable that the first measuring value is an average of values obtained by measuring an amount of light reflected from the image carrier within a predetermined number of times under substantially the same conditions, and that the third measuring value is an average of values obtained by measuring an amount of light reflected from the test pattern within a predetermined number of times under substantially the same conditions.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Figure 1:
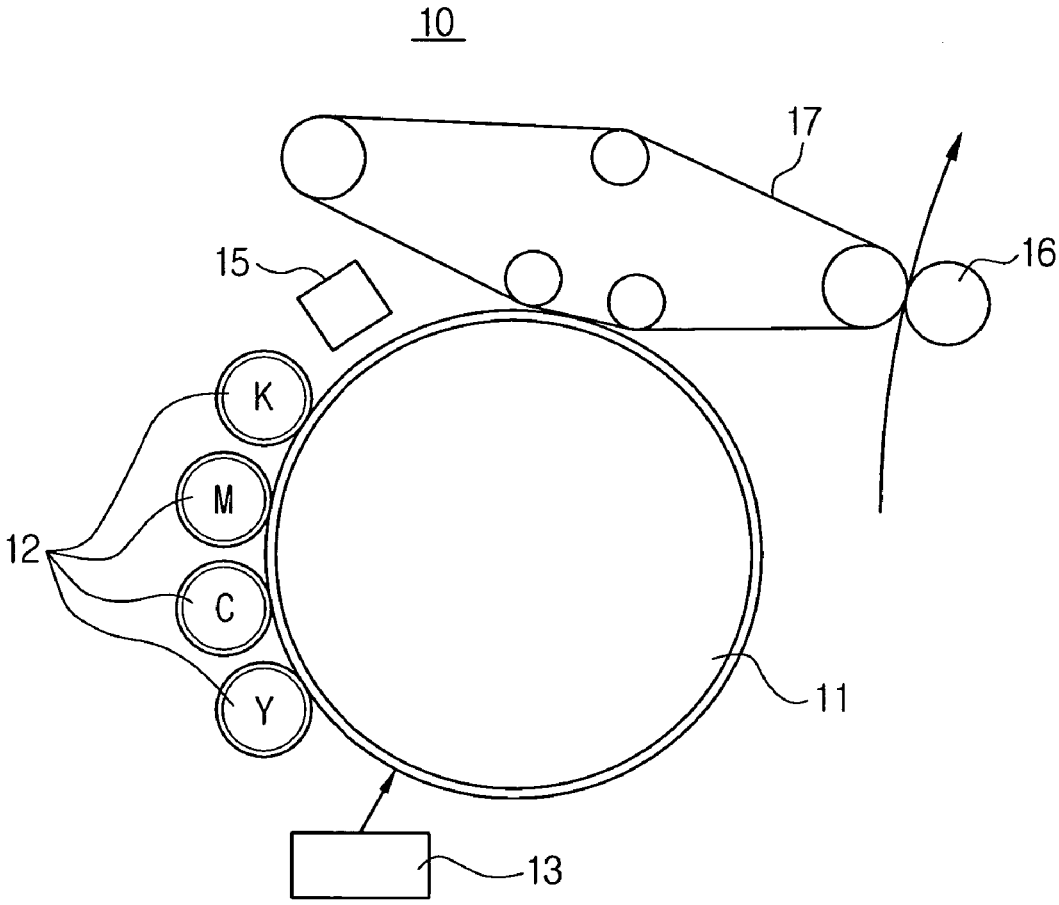
FIG. 1 (PRIOR ART)
FIG. 1 is a diagram illustrating a conventional developing unit of a laser beam printer which is capable of printing color images.

Certain embodiments of the present invention will now be described in greater detail with reference to the accompanying drawings.

In the following description, same drawing reference numerals are used for the same elements even in different drawings. The matters defined in the description, such as detailed construction and element descriptions, are provided to assist in a comprehensive understanding of the invention. Functions or constructions well known to those skilled in the art are not described in detail since they would obscure the invention in unnecessary detail.

Figure 2:
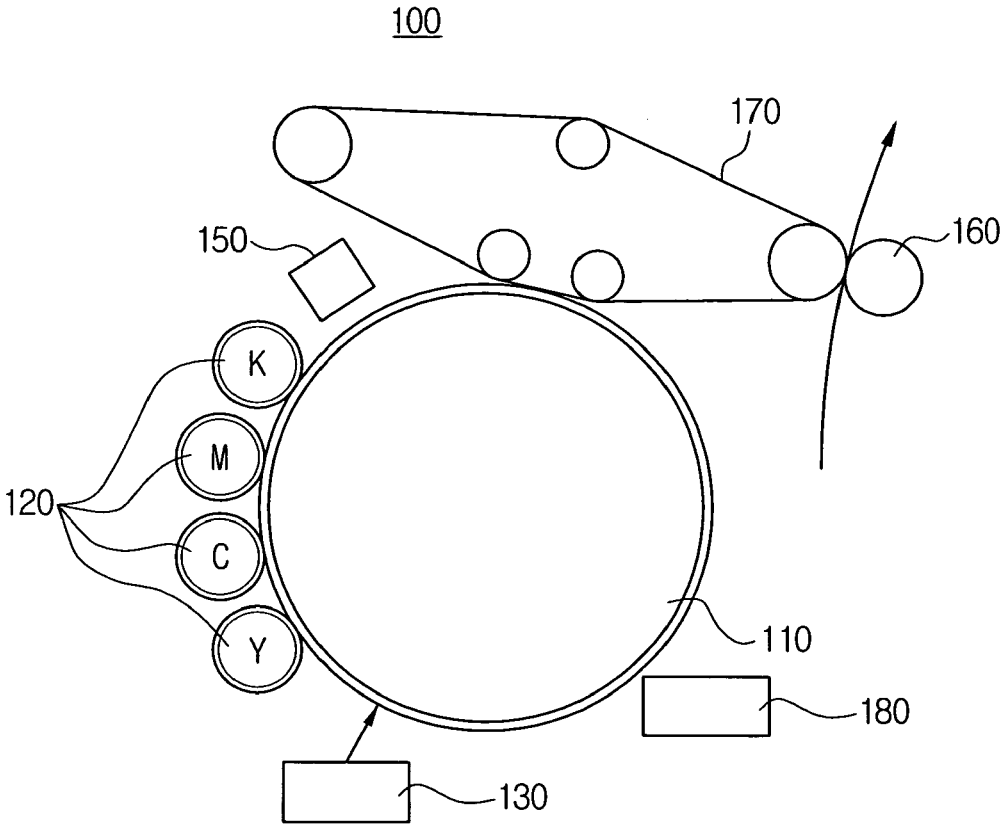
FIG. 2 is a diagram showing a developing unit of an image forming apparatus in accordance with a first exemplary embodiment of the present invention.

FIG. 2 is a diagram illustrating a developing unit of an image forming apparatus in accordance with a first exemplary embodiment of the present invention.

Referring to FIG. 2, the developing unit 100 includes an image carrier 110, a developer carrier 120, an optical beam scanning means 130, a density sensor 150, a transferring unit 160, an intermediate transferring unit 170, and an image carrier identifier 180. The above noted elements of the developing unit 100 have functions substantially similar to those of the developing unit 10 in FIG. 1, with the exception of the density sensor 150 and the image carrier identifier 180. Therefore, detailed explanations of the above noted elements are omitted as those are previously explained by referring to FIG. 1.

Figure 3:
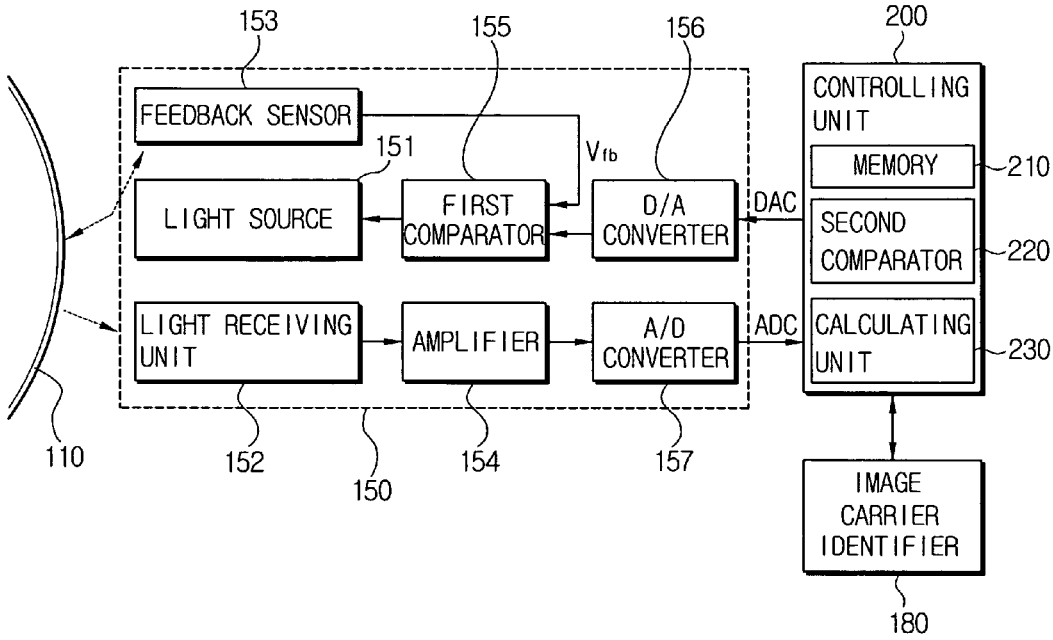
FIG. 3 is a block diagram depicting a developing unit in accordance with a first exemplary embodiment of the present invention.

FIG. 3 is a block diagram showing a developing unit in accordance with a first exemplary embodiment of the present invention.

Referring to FIG. 3, the density sensor 150 includes a light source 151 for irradiating a predetermined amount of light to the image carrier 110, a feedback sensor 153 for determining a state of the light source 151, a first comparator 155, a light receiving unit 152 for measuring an amount of light reflected from the image carrier 110, an amplifier 154 for amplifying a signal output from the light receiving unit 152, and a controlling unit 200 for calculating a predetermined measuring value based on the signal output from the light receiving unit 152 and for eliminating a signal input to the light source 151. The controlling unit 200 includes a memory 210 for storing a measuring value and reference data for comparison with the measuring value, a second comparator 220 for comparing the reference data and the measuring value, and a calculating unit 230 for performing operations to correct the measuring value of the light receiving unit 152 or to control a quantity of light output from the light source 151. The controlling unit 200 may be implemented with the image forming apparatus for performing only the above mentioned operations, but it is preferable that the controlling unit 200 be implemented with the image forming apparatus as a central processing unit for controlling the entire operation of the image forming apparatus, including a feeder (not shown) or an engine mechanism (not shown). The density sensor 150 further includes a D/A converter 156 for converting a signal input from the controlling unit 200 to the density sensor 150 into an analog signal, and an A/D converter 157 for converting a signal output from the density sensor 150 into a digital signal.

The image carrier identifier 180 identifies a unique identification (ID) of the image carrier 110 when the image carrier 110 is replaced, or when the image forming apparatus is initialized. Also, the image carrier identifier 180 transfers information related to the unique ID to the controlling unit 200.

Figure 4:
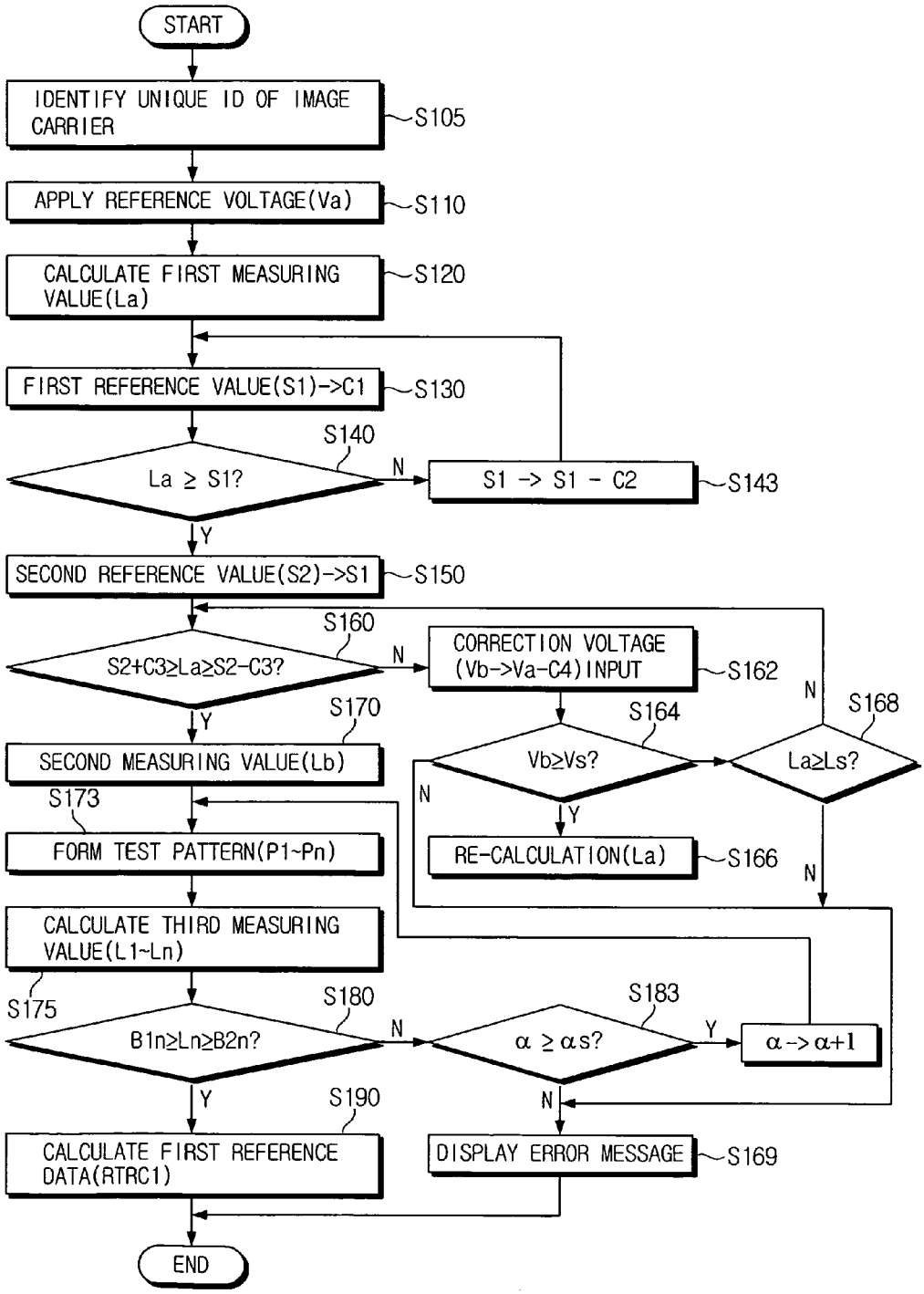
FIG. 4 is a flowchart showing a method for controlling an image forming apparatus in accordance with a first exemplary embodiment of the present invention.

FIG. 4 is a flowchart showing a method for controlling an image forming apparatus in accordance with a first embodiment of the present invention.

As shown in FIG. 4, a unique ID of the image carrier 110 is identified at step S105, and a predetermined reference voltage (Va) is applied to the light source 151 at step S110. Accordingly, a certain amount of light corresponding to the applied reference voltage (Va) is applied to the clean image carrier 110 where the developer is not applied. The light receiving unit 152 then measures an amount of light reflected from the image carrier 110 and obtains a first measuring value (La) based on the measured amount of reflected light at step S120. The first measuring value (La) represents a predetermined level value obtained by multiplying an output voltage of the density sensor 150 and a predetermined coefficient. It is preferable that the feedback sensor 152 determines whether a desired amount of light is irradiated from the light source 151 by directly receiving the light irradiated from the light source 151. Identifying the unique ID of the image carrier 110 can only occasionally be required, such as after a replacement of the image carrier 110, therefore in yet another embodiment of the present invention the step S105 can be omitted.

Figure 5:
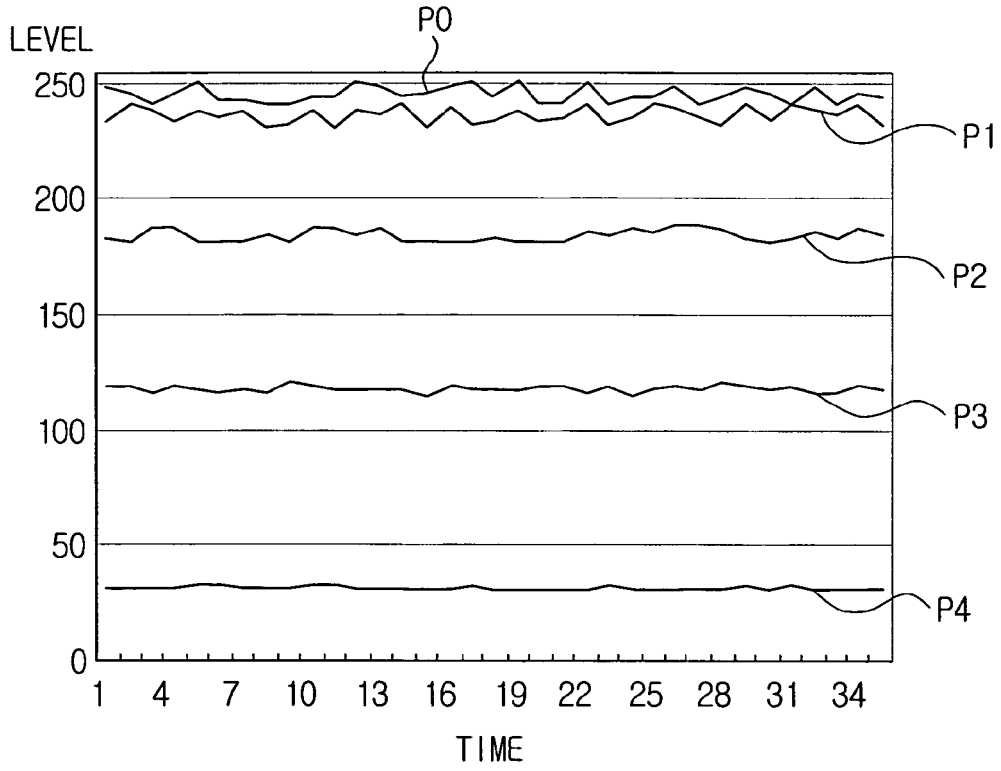
FIG. 5 is a graph showing changes of a third measuring value according to a time of calculation for the third measuring value in accordance with an exemplary embodiment of the present invention.
Figure 6:
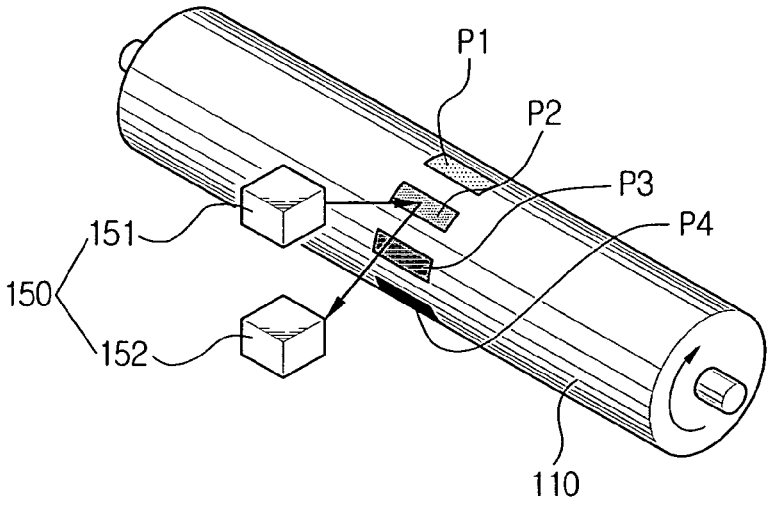
FIG. 6 is a perspective view showing a developing unit for illustrating the calculation of a third measuring value in accordance with an exemplary embodiment of the present invention.

A level of signal output from the density sensor 150 may be changed corresponding to developer density, which is defined as the toner area coverage (TAC), since an optical density sensor is used in the exemplary embodiment of the present invention. Referring to FIG. 5, a graph shows that the level of signal output from the density sensor 150 becomes dynamically changed when the developer density approaches P0, which represents 0% TAC. Accordingly, the density sensor 150 may obtain inaccurate measuring values, and the developer density of the image can be inaccurately measured during the driving of the image forming apparatus. For preventing the above problems, the light receiving unit 152 outputs a plurality of measuring values by repeatedly measuring an amount of light reflected from the image carrier within a predetermined number of times. The control unit 200 receives the measuring values from the light receiving unit 152 and determines a measuring value of each time by calculating an average value of the received measuring values.

As shown in FIG. 4, when the first measuring value (La) is obtained at step S120, a first reference value (S1) is set as a certain level (C1) corresponding to the first measuring value (La) at step S130. The reference value (S1) and other reference values are generally referred to as a calibration reference level (CRL). In the step S130, the first reference value (S1) is set to reflect a state where no developer is applied. Information related to the first reference value (S1) is stored in the memory 210 or is transmitted to the controlling unit 200 during the identifying of the unique ID of the image carrier 110. If the measuring values output from the density sensor 150 are within a range of 0 to 255 as in the exemplary embodiment of the present invention, the first reference values (S1) are preferably set as a plurality of numbers within a range of level values of about 150 to about 250 for accurately measuring the developer density.

After setting the first reference value (S1) at step S130, the first reference value (S1) and the first measuring value (La) are compared at step S140. If the first reference value (S1) is larger than the first measuring value (La) at step S140, the first reference value (S1) is corrected to be smaller than the first measuring value (La) by repeatedly subtracting a predetermined level value (C2) from the first reference value (S1) until the first reference value (S1) becomes smaller than the first measuring value (La) at step S143.

In the steps S140 and S143, the subtracting operations are repeatedly performed to find the largest first reference value from among the first reference values (S1), which is smaller than the first measuring value (La). Finding the largest first reference value is important because the measurement of developer density may become inaccurate if the first measuring value (La) is set to a level smaller than the first reference value (S1). Accordingly, any number of methods can be used in the step S143 for finding the largest first reference value, and to further set the first reference value (S1) to be smaller than the first measuring value (La).

After correcting the first reference value (S1) at step S143, the second reference value (S2) is set as the first reference value (S1) at step S150. At step S140, if the first reference value (S1) is smaller than the first measuring value (La), the first reference value (S1) is immediately set to the second reference value (S2).

After the step S150, the first measuring value (La) is corrected based on the second reference value (S2) for accurately measuring the developer density in the case where no developer is applied (that is, P0 in FIG. 5). The correction of the first measuring value (La) is performed as follows.

It is first determined whether the first measuring value (La) is within a first reference range at step S160. The first reference range includes levels similar to the second reference value (S2), and the first reference range is determined by adding the second reference value with an allowable error range (−C3~+C3).

If the first measuring value (La) is not within the first reference range, a predetermined correction voltage (Vb) is determined and applied to the light source 151 at step S162. The correction voltage (Vb) is obtained by adding the reference voltage (Va) with a correction value (C4) corresponding to a difference between the first reference range and the first measuring value (La). After correcting the amount of light irradiated to the image carrier 110 based on the correction voltage (Vb), the amount of reflected light of the image carrier 110 is measured again, and the first measuring value (La) is set again at step S166. As noted above, the re-setup of the first measuring value (La) is repeatedly performed until the obtained first measuring value (La) becomes included within the first reference range. However, if the correction voltage (Vb) and the first measuring value (La) become decreased below a predetermined level which adversely influences the measurement operation of the developer density at steps S164 and S168, an error message of the image forming apparatus is displayed at step 169.

If the first measuring value (La) is within the first reference range (S1), a second measuring value (Lb) is set as the first measuring value (La) at step S170. The second measuring value (Lb) is used as a reference for obtaining a first reference data (RTRC1) or a second reference data (RTRC2 in FIG. 8) in a case where no developer is applied (P0 in FIG. 5).

Figure 7:
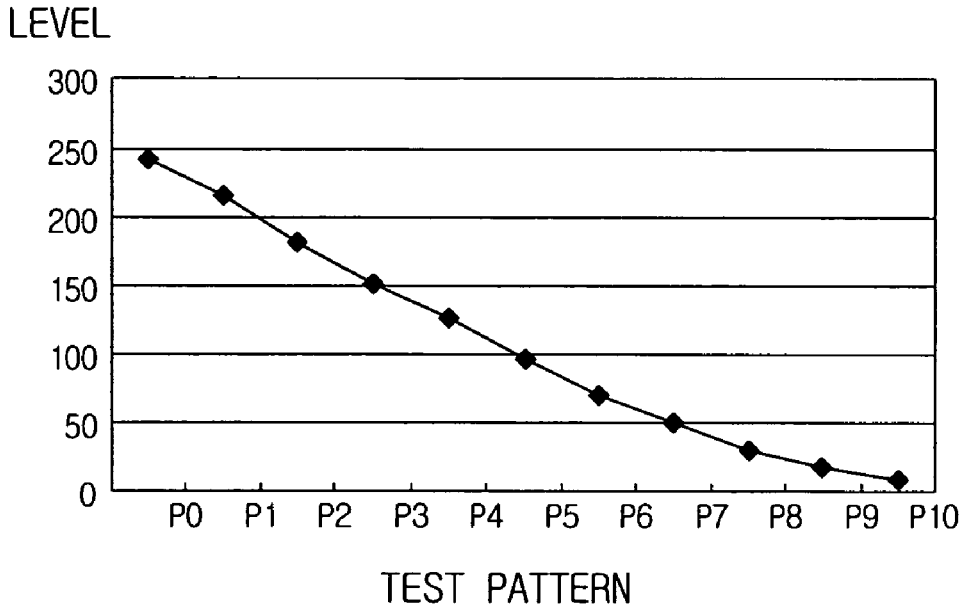
FIG. 7 is a graph showing third measuring values corresponding to test patterns in FIG. 4.

After setting the second measuring value (Lb), a plurality of test patterns (P1~Pn), each of which having a different developer density, are formed on the image carrier at step S173. Third measuring values (L1~Ln) are obtained corresponding to the plurality of the test patterns (P1~Pn), respectively, at step S175. The first reference data (RTRC1) is then obtained based on the third measuring values (L1~Ln) and the second measuring value (Lb), and the first reference data (RTRC1) is stored in the memory 210 at step S190. The first reference data (RTRC1) is a reference used for comparing measuring values in a case when measuring developer density of the image formed on the image carrier when the image forming apparatus is driving. The first reference data is determined as shown in FIG. 7. Generally, the reference data is referred to as the reference tone reproduction curve (RTRC). The second measuring value (Lb) is used as a reference value in the reference data (RTRC1) for a state where no developer is applied.

In the exemplary embodiment, the third measuring values (L1~Ln) are checked to determine whether the third measuring values were obtained correctly at step S180 to prevent an inaccurate calculation of the third measuring values (L1~Ln). If the third measuring values are incorrectly obtained, operations for forming the test patterns, or all operations, are repeatedly performed for obtaining correct third reference values. If the correct third measuring values are not obtained within a predetermined number of times of performing corresponding operations at step S183, the system determines that a malfunction of the image forming apparatus or a malfunction of the density sensor has occurred, and the method is terminated after displaying an error message at step S169.

The information of the constants (C1~C4) and reference values (S1, Va, Vs, Ls), can be defined in the step S105 for identifying the unique ID of the image carrier. Accordingly, the method of the present invention can be used without modification when image carriers from various manufacturers are implemented with the image forming apparatus.

Figure 8:
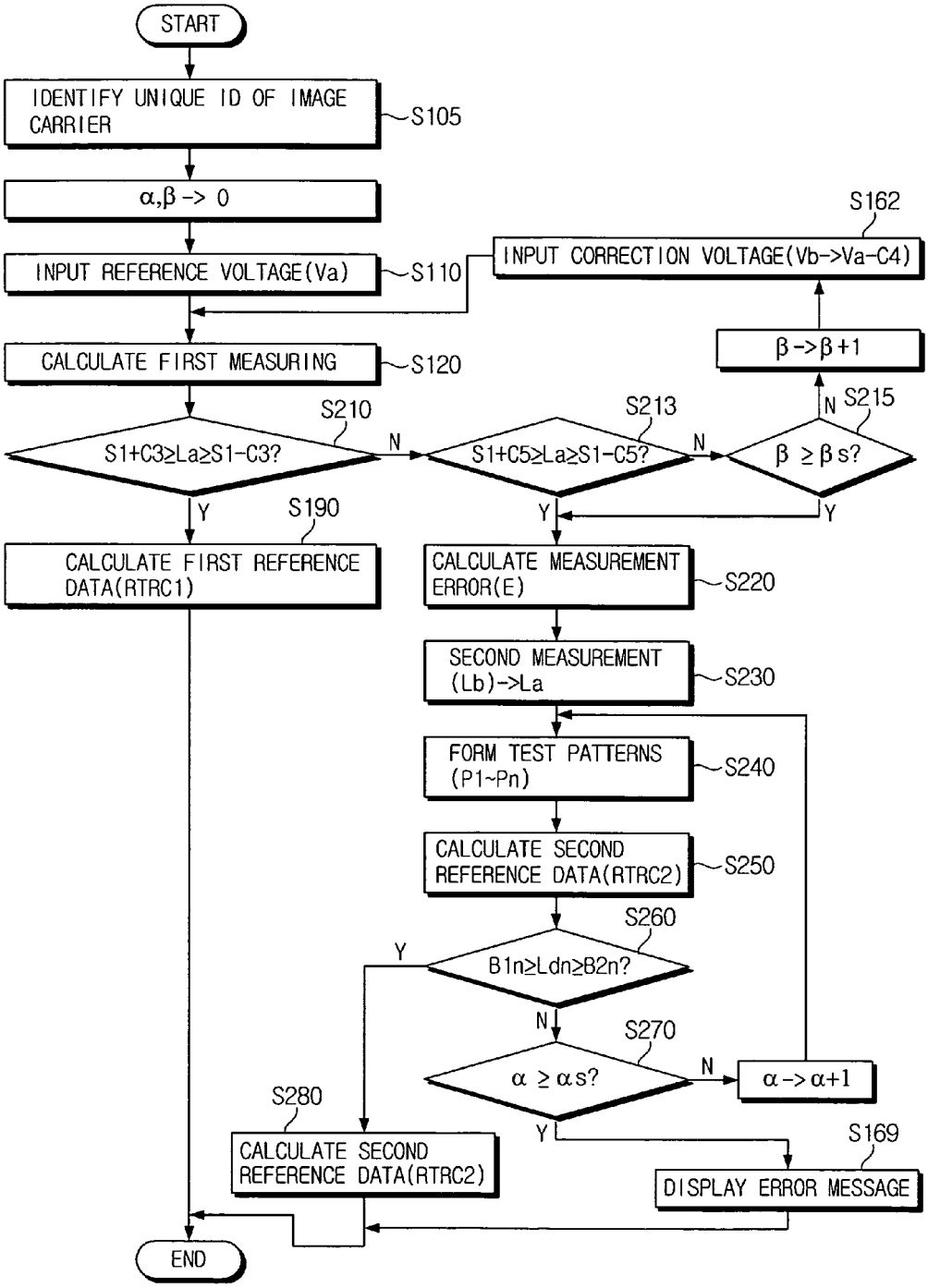
FIG. 8 is a flowchart showing a method for controlling an image forming apparatus in accordance with a second embodiment of the present invention.

FIG. 8 is a flowchart showing a method for controlling an image forming apparatus in accordance with a second embodiment of the present invention.

Steps S105, S110, and S120 for setting a first measuring value (La) in the second embodiment are substantially similar to those in the first embodiment and shown in FIG. 4. In the first embodiment, the measurement error of the developer density is corrected by re-setting the second reference value (S2) in steps S140 and S143 in FIG. 4. However, in the second embodiment, a sensitivity of a density sensor is corrected by immediately correcting a signal output from the density sensor 150. By correcting the sensitivity of the density sensor 150, the measurement error of the developer density is effectively corrected in cases where the measuring values are dynamically changed because of large amounts of received light.

For immediately correcting the signal output from the density sensor 150, the system determines whether a first measuring value (La) is within a predetermined first reference range at step S210 after obtaining the first measuring value (La) at step S120. It is preferable that the first reference range is defined by adding a first reference value (S1) and an allowable error range (−C3~+C3), where the first reference value (S1) is predetermined as corresponding to a state where no developer is applied. If the first measuring value (La) is within the first reference range at step S210, a plurality of test patterns are formed based on methods substantially the same as those of the first embodiment, and a first reference data (RTRC1) is set by obtaining third measuring values corresponding to the test patterns at step S190. After setting the first reference data (RTRC1), the method is terminated.

However, if the first measuring value (La) is not within the first reference range at step S210, an amount of light irradiated to the image carrier is controlled by applying a correction voltage (Vb) for adjusting the first measuring value (La) to be included within the first reference range at step S162. The above described method for controlling the amount of light may be achieved by increasing an amount of light irradiated to the image carrier. In the method of the second embodiment, a sensitivity of the density sensor 150 is determined based on a measurement error (E), which is a difference between the first measuring value (La) and the first reference range. That is, if the measuring error (E) is a positive number, the sensitivity of the density sensor 150 is determined as being too high and accordingly, the correction voltage sets a smaller reference voltage for reducing the amount of light. In contrast, if the measuring error (E) is a negative number, the sensitivity of the density sensor 150 is determined as being too low and the correction voltage sets a larger reference voltage. Therefore, the steps S162 and S120 are repeatedly performed for a predetermined number of times (defined as βs) until the first measuring value (La) is within the first reference range (Va).

If the first measuring value (La) is not within the first reference range (Va) after performing the steps S162 and S120 for the predetermined number of times (βs), it is determined that a correction of the first measuring value can not be performed at step S215. A second reference data (RTRC2) is then set by correcting the output signal of the density sensor 150 as follows.

First, the control unit 200 calculates the measurement error (E) for controlling an amount of the light irradiated from the light source 151 by using following equation (2) at step S220.

$$E=La-S1 \tag{2}$$

In equation (2), La is the first measuring value measured by the density sensor 150, and S1 is the reference value set to correspond to the reference voltage (Va).

After step S220, a second measuring value (Lb) is defined as the first measuring value at step S230. A plurality of test patterns (P1~Pn) are formed at step S240, and third measuring values corresponding to the test patterns are obtained. After obtaining the third measuring values, fourth measuring values (Ld1~Ldn) are obtained based on the obtained third measuring values at step S250. The obtained fourth measuring values are compared to a second reference range at step S260. The second reference range is substantially identical to the second reference range defined in the first embodiment. The second reference data (RTRC2) is defined based on the second measuring value (Lb) and the fourth measuring values (Ld1~Ldn), if the fourth measuring values are within the second reference range.

The fourth measuring values (Ld1~Ldn) can be obtained by various calculation methods based on the third measuring values (L1~Ln). In the second embodiment, the fourth measuring values (Ld1~Ldn) are obtained by following equation (3).

$$Ldn=Ln-(E\times S3n) \tag{3}$$

In equation (3), Ln represents the third measuring values of the test patterns (Pn), E is the measurement error obtained in step S220, and S3n is a reference sensitivity of the density sensor 150. The reference sensitivity (S3n) is previously defined as corresponding to the test pattern (Pn). For example, if a density of a first test pattern (P1) is defined as 12.5%, then the reference sensitivity (S31) is preset as 0.83. If a density of a second test pattern (P2) is defined as 25%, the reference sensitivity (S32) is preset as 0.53. Accordingly, if a density of an nth test pattern (Pn) is defined as 100%, the reference sensitivity (S3n) is preset as 0.06. The above mentioned preset density values may be varied according to the image carrier and accordingly, the correction of the sensitivity of the density sensor 150 can be effectively achieved by receiving the preset density values during the identifying of the unique ID of the image carrier 110.

Hereinafter, a method for calculating the fourth measuring values (Ldn) by using equation (3) is explained in greater detail. In an example case where the first measuring value (La) is obtained at step S220 and wherein the first reference value (S1) is defined as 235, the second reference range is defined as 195~201 (since the reference value of the first test pattern (P1) is defined as 198), the allowable error range is +3~−3, the reference sensitivity (S31) of the first test pattern (P1) is 0.83, and the third measuring value (L3) of the first test pattern (P1) is 185, then the measuring error (E) and the fourth measuring value (Ld1) of the first test pattern (P1) can be computed by following equations (4) and (5).

$$E=220-235=-15 \tag{4}$$

$$Ld1=185-(-15\times 0.83)=197.45 \tag{5}$$

As shown in equations (4) and (5), the fourth measuring value (Ld1) of the first test pattern (P1) is included within the second reference range (B11~B21) of the first test pattern (P1). Accordingly, the fourth measuring value (Ld1) can be used as the second reference data (RTRC2).

It is preferable that the second reference data (RTRC2) be calculated as a continuous curve formed by connecting the fourth measuring values (Ld1~Ldn) on a graph as shown in FIG. 7. The continuous curve connecting each of the fourth measuring values can be calculated by using various methods, such as interpolation. In this case, it is possible to predict a measuring value output from the density sensor corresponding to the developer density of the image formed on the image carrier by reverse operation of equation (3). By predicting the measuring value, it is also possible to measure a density of the developer by immediately comparing the predicted measuring value with values output from the density sensor 150 as the image forming apparatus is printing images. For example, if the value output from the density sensor 150 is 185, it is easy to predict the corresponding second reference data as 197.45. Accordingly, the corresponding test pattern is easily determined as the first test pattern 1(P1) and also the corresponding developer density as 12%. Additionally, the developer density of the image formed on the image carrier 110 can be measured by various methods comparing the second reference data with the value output from the density sensor 150.

Returning to FIG. 8, the method for controlling the density sensor 150 in accordance with the second embodiment of the present invention further includes step S213 for determining whether the first measuring value (La) is included within the third reference range before calculating the second reference data (RTRC2). In step S213, a method for correcting the sensitivity of the density sensor 150 is decided by selecting one of a method for controlling an amount of light irradiated from the light source 151, and another method for controlling the sensitivity of the density sensor 150. Therefore, it is preferable that the third reference range should be defined as a range which is possible for correcting the sensitivity of the density sensor 150, and which is impossible for correcting the amount of light irradiated from the light source. In the case where the amount of reflected light is large, an output level of the density sensor 150 is changed radically so it can be very difficult to control the quantity of light in order for the first measuring value to be within the first reference range. Accordingly, the third reference range should be defined as a slightly larger range than the first reference range for immediately performing steps of calculating the second reference data (RTRC2) in the case where the first measuring value is between the first reference range and the third reference range. By the process noted above, the correction of the sensitivity of the density sensor 150 can be quickly performed.

Figure 9:
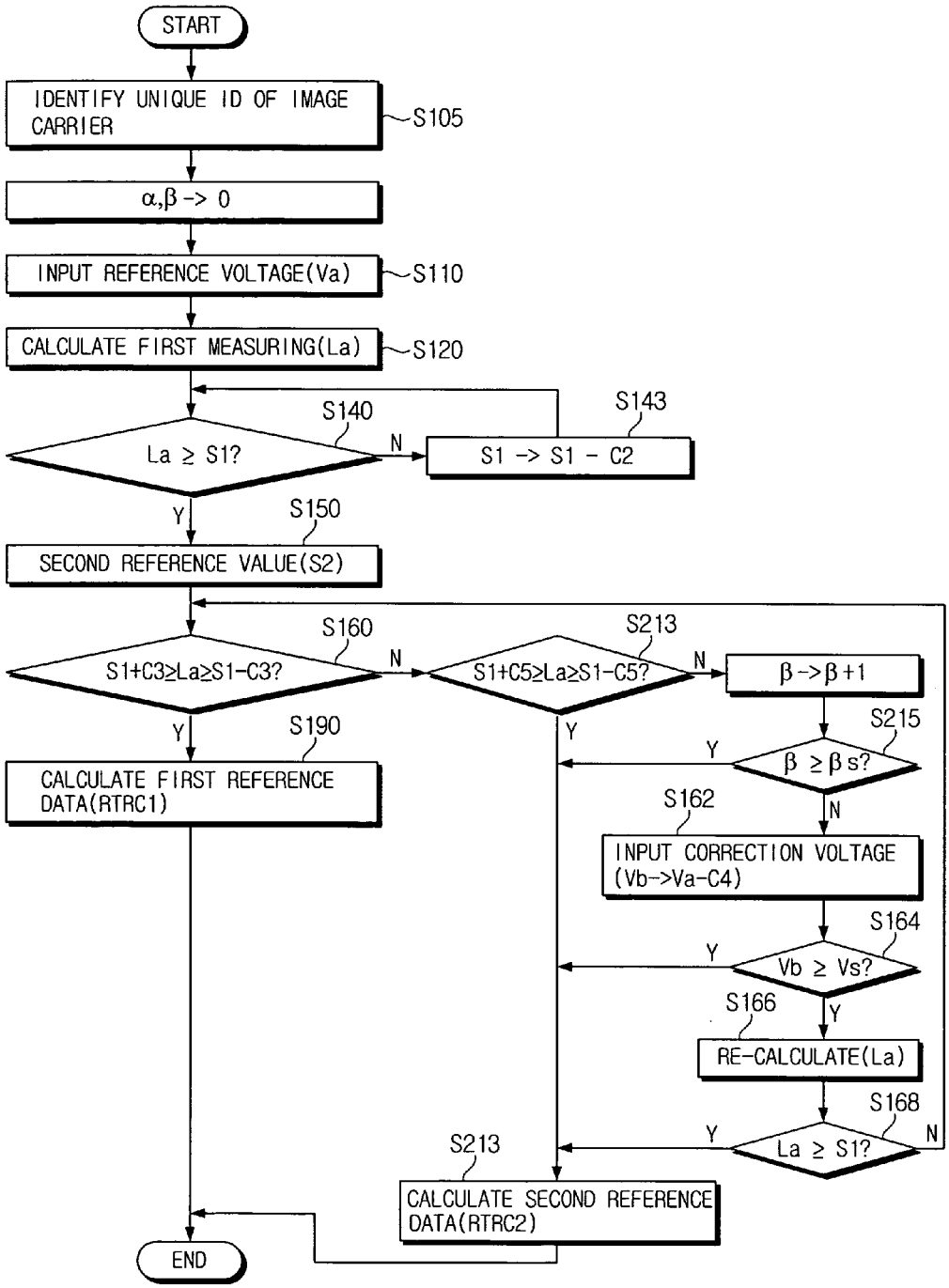
FIG. 9 is a flowchart showing a method for controlling an image forming apparatus in accordance with a third embodiment of the present invention.

FIG. 9 is a flowchart showing a method for controlling an image forming apparatus in accordance with a third embodiment of the present invention.

The method of the third embodiment is a combined method including the first embodiment and the second embodiment. Hereinafter, the method of the third embodiment is described in greater detail.

After a first measuring value (La) is calculated at step S120, a first reference value (S1) is controlled based on the first measuring value at steps S140 and S143. The steps S140 and S143 are substantially identical to those of the first embodiment shown in FIG. 4. After controlling the first reference, a second reference value (S2) is defined at step S150 and the first measuring value is compared to the first reference range at step S160. The first reference range is defined substantially the same as in the first embodiment. If the first measuring value is within the first reference range at step S160, a first reference data (RTRC1) is obtained at step S190. The step S190 is substantially identical to that in the first embodiment shown in FIG. 4.

If the first measuring value is not within the first reference range at step S160, the first measuring value (La) is corrected by applying a correction voltage (Vb) at steps S162 and S166 as in the first and the second embodiments. However, in the third embodiment, a second reference data (RTRC2) is calculated when the first measuring value is decreased below that of a predetermined reference level (Vs, Ls) during the controlling of the first measuring value. In contrast, in the methods of the first and the second embodiments, the process is terminated when the first measuring value is decreased below that of the predetermined reference level (Vs, Ls) during the controlling of the first measuring value. The second reference data (RTRC2) is calculated by the steps S220, S230, S240, S250, S260 and S280 in FIG. 8. In this case, if the first measuring value is out of the first reference range and within the third reference range at step S213, the steps for setting the second reference data (RTRC2) are performed without a correction of the first measuring value. Also, if the calculation of the second reference data fails, the method is terminated as shown in FIG. 8.

The method of the third embodiment can be used to "finely" correct the sensitivity of the density sensor 150 in response to various environments, since the method of the third embodiment is a combined method of both the first embodiment and the second embodiment.

The above described controlling methods of the present invention can be further explained by using the image forming apparatus to print a black and white image as an example. However, the controlling methods of the present invention can also be implemented to control the image forming apparatus for printing a color image by repeatedly performing the controlling method per each color of developer.

As noted above, the present invention corrects the sensitivity of the density sensor by selectively combining at least one of a method for controlling a quantity of light irradiated to the image carrier from the light source, a method for controlling the first measuring value, and a method for correcting signals output by corresponding each to a test pattern. Therefore, the present invention can finely correct the sensitivity of the density sensor when a print environment is dynamically changed, such as caused by the replacement or aging of the image carrier. Accordingly, the present invention can prevent degradation of printing quality and malfunctioning of the image forming apparatus caused by an error of the density sensor.

The foregoing embodiments and advantages are merely exemplary and are not to be construed as limiting the present invention. The present teaching can be readily applied to other types of apparatuses. Also, the descriptions of the embodiments of the present invention are intended to be illustrative, and not to limit the scope of the claims, and many alternatives, modifications, and variations will be apparent to those skilled in the art.

What is claimed is:

1. A controlling method of an image forming apparatus having a density sensor measuring a toner area coverage (TAC) applied on an image carrier, the method measuring an amount of light reflected from the image carrier and outputting a measuring value based on the measured toner area coverage, the controlling method comprising the steps of:

calculating a first measuring value corresponding to an amount of light reflected from the image carrier after a predetermined optical beam is scanned to the image carrier;

defining a second reference value by selecting one of a predetermined first reference values which is substantially near in value to the first measuring value;

calculating a second measuring value as a reference for comparison when a toner area coverage (TAC) of an image formed on the image carrier is measured during a driving of the image forming apparatus; and correcting a sensitivity of the density sensor which corrects the first measuring value based on the second reference value.

2. The controlling method as recited in claim 1, wherein the step of defining the second reference value further comprises the step of selecting one of the first reference values that is smaller than the first measuring value.

3. The controlling method as recited in claim 2, wherein the step of defining the second reference value further comprises the step of selecting a largest one from among the first reference values that are smaller than the first measuring value.

4. The controlling method as recited in claim 2, wherein the step of defining the second reference value further comprises the steps of:

a) calculating a new first reference value by repeatedly subtracting a predetermined constant from the largest one from among the first reference values for a predetermined number of times; and b) defining the newly calculated first reference value as the second reference value.

5. The controlling method as recited in claim 4, wherein the predetermined constant is repeatedly subtracted from the largest first reference value until the newly calculated first reference value becomes smaller than the first measuring value.

6. The controlling method as recited in claim 4, wherein the step of defining the second reference value further comprises the step of determining that the correction of sensitivity of the density sensor has failed when the finally calculated first reference value is smaller than the first measuring value.

7. The controlling method as recited in claim 2, wherein the step of defining the second reference value further comprises the steps of:

controlling an amount of light irradiated to the image carrier until the density sensor outputs a first measuring value substantially nearest in value to the second reference value; and defining the final first measuring value as the second measuring value.

8. The controlling method as recited in claim 7, wherein the step of defining the second reference value further comprises the step of determining that the controlling of the sensitivity of the density sensor has failed when the controlled amount of light is smaller than a predetermined minimum amount of light.

9. The controlling method as recited in claim 2, wherein the step of defining the second reference value further comprises the step of determining that the controlling of the sensitivity of the density sensor has failed when the calculated second reference value is smaller than a predetermined minimum reference value.

10. The controlling method as recited in claim 1, further comprising the step of determining that the controlling of the sensitivity of the density sensor has failed when a predetermined condition is not satisfied.

11. The controlling method as recited in claim 10, further comprising the steps of:

applying a plurality of test patterns, each of which having different TAC, on the image carrier and calculating a plurality of third measuring values corresponding to the TAC of the plurality of test patterns, wherein the predetermined condition is satisfied when the second measuring value is calculated; and calculating a first reference data by processing the calculated third measuring values, where the first reference data is for comparison when the TAC of an image formed on the image carrier is measured during a driving of the image forming apparatus.

12. The controlling method as recited in claim 10, wherein an output signal of the density sensor is corrected by a predetermined correcting process when there is a failure to correct the sensitivity of the density sensor and the TAC of an image formed on the image carrier is measured during a driving of the image forming apparatus.

13. The controlling method as recited in claim 12, wherein the output signal of the density sensor is corrected by the steps of:

applying a plurality of test patterns, each of which having a different TAC, on the image carrier and calculating a plurality of third measuring values corresponding to the TAC of the plurality of test patterns;

correcting the third measuring values by using the predetermined correcting process and calculating a plurality of fourth measuring values corresponding to each of the third measuring values; and calculating second reference data by processing the plurality of fourth measuring values, wherein the second reference data is a reference for comparison when the TAC of an image formed on the image carrier is measured during a driving of the image forming apparatus.

14. The controlling method as recited in claim 13, wherein:

a first reference data is calculated by processing the third measuring values when the second measuring value is within a predetermined first reference range; and wherein the second reference data is calculated by processing the fourth measuring values when the second measuring value is within the first reference range, wherein the first reference data is for comparison when measuring the TAC of an image formed on the image carrier.

15. The controlling method as recited in claim 14, wherein when the second measuring value is out of the first reference range which is defined by adding the second reference value and predetermined error range, the step for calculating the fourth measuring value further comprises the steps of:

calculating a measurement error comprising a difference between the second measuring value and the second reference value; and calculating the fourth measuring values by performing the predetermined correction process based on the calculated measurement error and the third measuring value.

16. The controlling method as recited in claim 15, wherein the fourth measuring value (Ldn) is calculated using following equation:

$$Ldn=Ln-(E\times S3n),$$

wherein E is a measurement error, S3n is a predetermined third reference value corresponding to an $n^{th}$ test pattern from among the test patterns, and Ln is a third measuring value calculated by measuring the $n^{th}$ test pattern.

17. The controlling method as recited in claim 16, wherein the image forming apparatus comprises an image carrier identifying unit for identifying unique identification information of different image carriers, and wherein the unique identification information includes information related to the first reference value, the third reference value, and the first reference range.

18. The controlling method as recited in claim 13, wherein the second reference data is defined based on the fourth measuring values and the second measuring value when the fourth measuring values are within a second reference range, and the steps for calculating the third measuring values are repeatedly performed when the fourth measuring values are out of the second reference range.

19. The controlling method as recited in claim 18, wherein the steps for calculating the third measuring values further comprises the steps of:

repeatedly performing the steps of calculating the third measuring values until the fourth measuring values are within the second reference range when a calculated fourth measuring value is out of the second reference range; and detecting a malfunction of the image forming apparatus after terminating the method when the fourth measuring values are still out of the second reference range after repeatedly performing the steps for calculating the third measuring values for a predetermined number of times.

20. The controlling method as recited in claim 13, wherein the steps for calculating the second measuring values further comprises the steps of:

performing the steps of calculating the second measuring values when the first measuring value is out of the first reference range and is also out of the third reference range, wherein the third reference range is defined as a wider range compared with the first reference range; and defining the first measuring value as the second measuring value, calculating the third measuring value, and calculating the fourth measuring value in order when the first measuring value is out of the first reference range and is within the third reference range.

21. The controlling method as recited in claim 12, wherein in the step for defining the second reference value, the second reference value is defined by selecting one of the first reference values which is smaller than the first measuring value.

22. The controlling method as recited in claim 21, wherein in the step for defining the second reference value, the second reference value is defined by selecting the largest one from among the first reference values which are smaller than the first measuring value.

23. The controlling method as recited in claim 21, wherein the step for defining the second reference value further comprises the steps of:

a) calculating a new first reference value by repeatedly subtracting a predetermined constant from a largest one from among the first reference values for a predetermined number of times; and b) defining the newly calculated first reference value in the step a) as the second reference value.

24. The controlling method as recited in claim 23, wherein the predetermined constant is repeatedly subtracted from the largest one from among the first reference values until the first reference value is smaller than the first measuring value.

25. The controlling method as recited in claim 24, wherein a correction failure of the sensitivity of the density sensor is determined when a finally calculated first reference value is smaller than a predetermined minimum reference value.

26. The controlling method as recited in claim 21, wherein the step for defining the second measuring value further comprises the steps of:

controlling an amount of light irradiated to the image carrier until the density sensor outputs a first measuring value substantially nearest in value to the second reference value; and defining the finally output first measuring value as the second measuring value.

27. The controlling method as recited in the claim 26, wherein a correction failure of the sensitivity of the density sensor is determined when the controlled amount of light is smaller than a predetermined minimum amount of light, wherein the controlled amount of light is an amount of light providing the final calculated first measuring value.

28. The controlling method as recited in claim 14, wherein the image forming apparatus comprises a plurality of developing units for providing a plurality of developer colors to the image carrier for recording color images, and wherein the first and the second reference data are independently defined according to each of the developers.

29. The controlling method as recited in claim 13, wherein the first measuring value comprises an average of values obtained by measuring an amount of light reflected from the image carrier within a predetermined number of times under substantially similar conditions, and wherein the third measuring value comprises an average of values obtained by measuring an amount of light reflected from the test pattern within a predetermined number of times under substantially similar conditions.

30. A controlling method of an image forming apparatus, including a density sensor outputting a measuring value corresponding to a toner area coverage (TAC) applied on an image carrier, the method measuring an amount of light reflected from the image carrier, the controlling method comprising the steps of:

calculating a first measuring value corresponding to an amount of light reflected from the image carrier after a predetermined light is irradiated to the image carrier, and comparing the first measuring value with a predetermined first reference range; and correcting an output signal of the density sensor by using a predetermined correcting process when the first measuring value is out of the first reference range, wherein the TAC of an image formed on the image carrier is measured based on a result of the predetermined correcting process.

31. The controlling method as recited in claim 30, wherein the step for correcting an output signal of the density sensor comprises the steps of:

calculating a second measuring value by correcting the first measuring value to be substantially near in value to the first reference range;

comparing the second measuring value and the first reference range; and forming a plurality of test patterns, each of which having a different TAC, on the image carrier and calculating a plurality of third measuring values for each of the test patterns.

32. The controlling method as recited in claim 31, wherein a first reference data is calculated by processing the third measuring values, wherein the first reference data is a reference for comparison when the TAC of an image formed on the image carrier is measured during a driving of the image forming apparatus when the second measuring value is within the first reference range.

33. The controlling method as recited in claim 31, wherein the step for correcting an output signal of the density sensor when the second measuring value is out of the first reference range, wherein the first reference range is defined by adding a predetermined first reference value and an error range, further comprises the steps of:

calculating a plurality of fourth measuring values corresponding to the third measuring values by correcting the third measuring values after calculating a plurality of third measuring values for each of the test patterns; and calculating a second reference data by processing the fourth measuring values and the second measuring values, wherein the second reference data is a reference for comparison when the TAC of the image is measured during a driving of the image forming apparatus.

34. The controlling method as recited in claim 33, wherein the step for calculating the fourth measuring values comprise the steps of:

calculating a measurement error which comprises a difference between the first reference value and the second measuring value; and calculating the fourth measuring values by performing the correction process based on the calculated measurement error and the third measuring value.

35. The controlling method as recited in claim 34, wherein the fourth measuring values (Ldn) are calculated using following equation:

$$Ldn = Ln - (E \times S3n)$$

wherein E is a measurement error, S3n is a predetermined third reference value corresponding to an $n^{th}$ test pattern from among the test patterns, and Ln is a third measuring value calculated by measuring the $n^{th}$ test pattern.

36. The controlling method as recited in claim 35, wherein the image forming apparatus comprises an image carrier identifying unit for identifying unique identification information of different image carriers, and wherein the unique identification information includes information related to the first reference value, the third reference value, and the first reference range.

37. The controlling method as recited in claim 33, wherein the second reference data is defined based on the fourth reference values when the fourth reference values are included within a second reference range and which correspond to each of the test patterns, and the fourth measuring values are repeatedly calculated by repeatedly performing the step for calculating the third measuring values when the fourth measuring values are out of the second reference range.

38. The controlling method as recited in claim 37, wherein the step for calculating the third measuring values further comprises the steps of:

repeatedly performing the steps of calculating the third measuring values until the fourth reference values are within the second reference range when the newly set fourth reference values are out of the second reference range; and terminating the process after a malfunction of the image forming apparatus is detected, wherein the malfunction is detected when the fourth reference values are out of the second reference range after performing the step for calculating the third measuring values after a predetermined number of times.

39. The controlling method as recited in claim 33, wherein the step for calculating the second measuring values further comprises the steps of:

performing the step of calculating the second measuring values when the first measuring value is out of the first reference range and the first reference range is out of the third reference range, wherein the first measuring value is defined as the second measuring value; and calculating the third measuring value and calculating the fourth measuring value in order when the first measuring value is out of the first reference range and is within the third reference range.

40. The controlling method as recited in claim 39, wherein the step for calculating the second measuring values further comprises the steps of:

controlling an amount of light irradiated to the image carrier until the density sensor outputs a first measuring value substantially nearest in value to the first reference value; and defining a first measuring value finally output from the density sensor as the second measuring value.

41. The controlling method as recited in claim 33, wherein the image forming apparatus comprises a plurality of developing units for providing a plurality of developer colors to the image carrier for recording color images, and wherein the second reference data is independently defined for each of the developers.

42. The controlling method as recited in claim 31, wherein the first measuring value comprises an average of values obtained by measuring an amount of light reflected from the image carrier within a predetermined number of times under substantially similar conditions, and wherein the third measuring value comprises an average of values obtained by measuring an amount of light reflected from the test pattern in a predetermined number of times under substantially similar conditions.

43. The controlling method as recited in claim 31, including the steps of:

defining the first measuring value as the second measuring value when the first measuring value is within the first reference range;

calculating a plurality of third measuring values corresponding to each of the test patterns after forming a plurality of test patterns on the image carrier, wherein each of the test patterns is formed having a different TAC; and calculating the first reference data by processing the third measuring values, wherein the first reference data is a reference for comparison during a driving of the image forming apparatus.

* * * * *